US011400498B2

(12) United States Patent
Kirchner

(10) Patent No.: US 11,400,498 B2
(45) Date of Patent: Aug. 2, 2022

(54) CROSS-ROLLING MILL

(71) Applicant: SMS Group GmbH, Duesseldorf (DE)

(72) Inventor: Walter Kirchner, Viersen (DE)

(73) Assignee: SMS GROUP GMBH, Duesseldorf (DE)

( * ) Notice: Subject to any disclaimer, the term of this patent is extended or adjusted under 35 U.S.C. 154(b) by 489 days.

(21) Appl. No.: 16/341,130

(22) PCT Filed: Oct. 10, 2017

(86) PCT No.: PCT/EP2017/075784
§ 371 (c)(1),
(2) Date: Apr. 11, 2019

(87) PCT Pub. No.: WO2018/069303
PCT Pub. Date: Apr. 19, 2018

(65) Prior Publication Data

US 2020/0188973 A1 Jun. 18, 2020

(30) Foreign Application Priority Data

Oct. 11, 2016 (DE) ..... 102016219723.1

(51) Int. Cl.
*B21B 19/06* (2006.01)
*B21B 13/00* (2006.01)
(Continued)

(52) U.S. Cl.
CPC ..... *B21B 19/06* (2013.01); *B21B 13/008* (2013.01); *B21B 1/20* (2013.01); *B21B 19/04* (2013.01); *B21B 31/08* (2013.01); *B21B 2203/32* (2013.01)

(58) Field of Classification Search
CPC ..... B21B 19/02; B21B 19/04; B21B 19/06; B21B 31/18; B21B 31/185; B21B 31/22; B21B 31/32
(Continued)

(56) References Cited

U.S. PATENT DOCUMENTS 2,017,374 A 10/1935 Olson
3,651,675 A * 3/1972 Stone ..... B21B 29/00 72/11.7
(Continued)

FOREIGN PATENT DOCUMENTS

DE 10030823 A1 * 1/2002 ..... B21B 13/008
EP 0732157 9/1996
(Continued)

*Primary Examiner* — Shelley M Self
*Assistant Examiner* — Katie L. Parr
(74) *Attorney, Agent, or Firm* — Abelman, Frayne & Schwab

(57) ABSTRACT

The invention relates to a cross-rolling mill, having a plurality of roll shafts (1), each applying a radially directed rolling force to a workpiece, wherein orientation of a roll axis (w) of at least one of the roll shafts (1) adjustably changes about a first adjustment axis (S1) and a second adjustment axis (S2), wherein an intermediate member (9, 10) is arranged between a rotary baring (4, 5) and a control element (11, 12), and wherein the intermediate member (9, 10) includes a rolling force-transmitting rocker pin (14, 15) having a spherical surface (14*a*, 14*b*, 15*a*, 15*b*) that provides for pivotal movement in a plurality of directions.

10 Claims, 2 Drawing Sheets

(51) Int. Cl.
*B21B 1/20* (2006.01)
*B21B 19/04* (2006.01)
*B21B 31/08* (2006.01)

(58) Field of Classification Search
USPC ..... 72/237, 245, 246, 199–252.5
See application file for complete search history.

(56) References Cited

U.S. PATENT DOCUMENTS 4,242,894 A * 1/1981 von Dorp ..... B21B 19/06
72/96
4,348,952 A * 9/1982 Gooch ..... B21B 13/023
72/237
4,574,606 A 3/1986 Hausler
5,655,398 A * 8/1997 Ginzburg ..... B21B 13/023
72/241.4
5,924,319 A * 7/1999 Ginzburg ..... B21B 31/185
72/247

FOREIGN PATENT DOCUMENTS

EP 3108978 A1 * 12/2016 ..... B21B 31/32
JP 3334771 B2 * 10/2002 ..... B21B 31/02

* cited by examiner

CROSS-ROLLING MILL

RELATED APPLICATIONS

This application is a National Phase application of International application PCT/EP2017/075784 filed Oct. 10, 2017 and claiming priority of German application DE 10 2016 219 723.1 filed Oct. 26, 2016, both applications are incorporated herein by reference thereto.

The invention relates to a cross-rolling mill according to the preamble of the independent claim.

DE 3406841 discloses a three-roll cross-rolling mill with rolls having conical rolling surfaces and in which for adjusting the roll shafts, a pivotal movement about a respective axis can be carried out.

In other known cross-rolling arrangements, e.g., according to an Assel mill process, adjustment of a roll shaft can take place about two different axes.

Decoupling of transverse forces between contact surfaces produced by adjustment require use of intermediate elements which increases the height of the installation.

The object of the invention is a cross-rolling mill in which a low-friction adjustment of roll shafts becomes possible.

According to the invention, this object is achieved, for the above-mentioned cross-rolling mill by characterized features of the independent claim. The pivotability of the rocker pin provides for a simple and low-friction position adjustment between the roll shaft and the control element which can take place in different directions.

The number of roll shafts can advantageously amount to two, three, and even four. In particular, the cross-rolling mill can operate according to the Assel mill process or method or at least a similar one.

The alignment of the roll axis about the adjustment axis means geometrical adjustment for purposes of the invention so that the adjustment axis should not have any bodily shaft or the like. Preferably, the adjustment axes can extend perpendicular to the roll axis, but also in particular perpendicular to one another. Within the meaning of the invention, any actuator with which a roll axis can be adjusted, may be considered as a control element. As an actuator, in particular, a hydraulic cylinder or an electromechanically actuator can be used. Generally, preferably, the actuator is so configured that the rolling force is applied to a workpiece.

In an advantageous embodiment of the invention, the roll shaft has, at the two opposite ends thereof, respectively, a rotary bearing and a pivotable rocker pin. In this way, the pivotable rocker pin provides a complete and low-friction support.

For providing a simple and effective construction, it is generally advantageous for the roll shaft to be received in a roll housing, with the roll housing being displaceably supported by rocker pins for pivotal movement about the adjustment axis. The roll housing can be formed as a rigid frame but displaceable relative to a stand.

In advantageous detail design, preferably a hydraulic tension element applies, to the roll housing, a force in a direction opposite the direction of the rolling force. Thereby, together with the forces of the control element, a totally play-free mounting of the roll in a respective position is achieved.

In an advantageous embodiment of the invention, a bearing cap is pivotably arranged against at least one end of the rocker pin. This insures a simple lateral displacement of the support point of the rocker pin or the bearing cap. In addition, the bearing cap can be replaced in a simple way as a wear part.

For a variable positioning, it is advantageously provided that the rocker pin is pivotable, starting from a neutral position, in each spatial direction by an angle about a pivot point.

Altogether, advantageously, at least two roll shafts, preferably, at least three roll shafts, particularly advantageously, all of the roll shafts of the cross-roll mill are adjustably supported according to one of the features described above.

Generally, the inventive mounting of a roll shaft or roll shafts provides for compensation of the radial movements relative to the adjustment axis. Similarly, compensation of angular deviations perpendicular to the adjustment becomes possible. In addition, the constructional height and, thereby, the frame size and weight of the cross-rolling mill are reduced by the invention.

The invention eliminates or reduces friction and transverse forces of the used components. A further advantage consists in an improved positioning accuracy under load. Further, the vibration behavior of the used system is improved, and the overall rigidity is increased.

Further advantages and features will become apparent from the following description of an embodiment example and dependent claims.

Below, a preferred embodiment of the invention will be described in detail with reference to the accompanying drawings.

Figure 1:
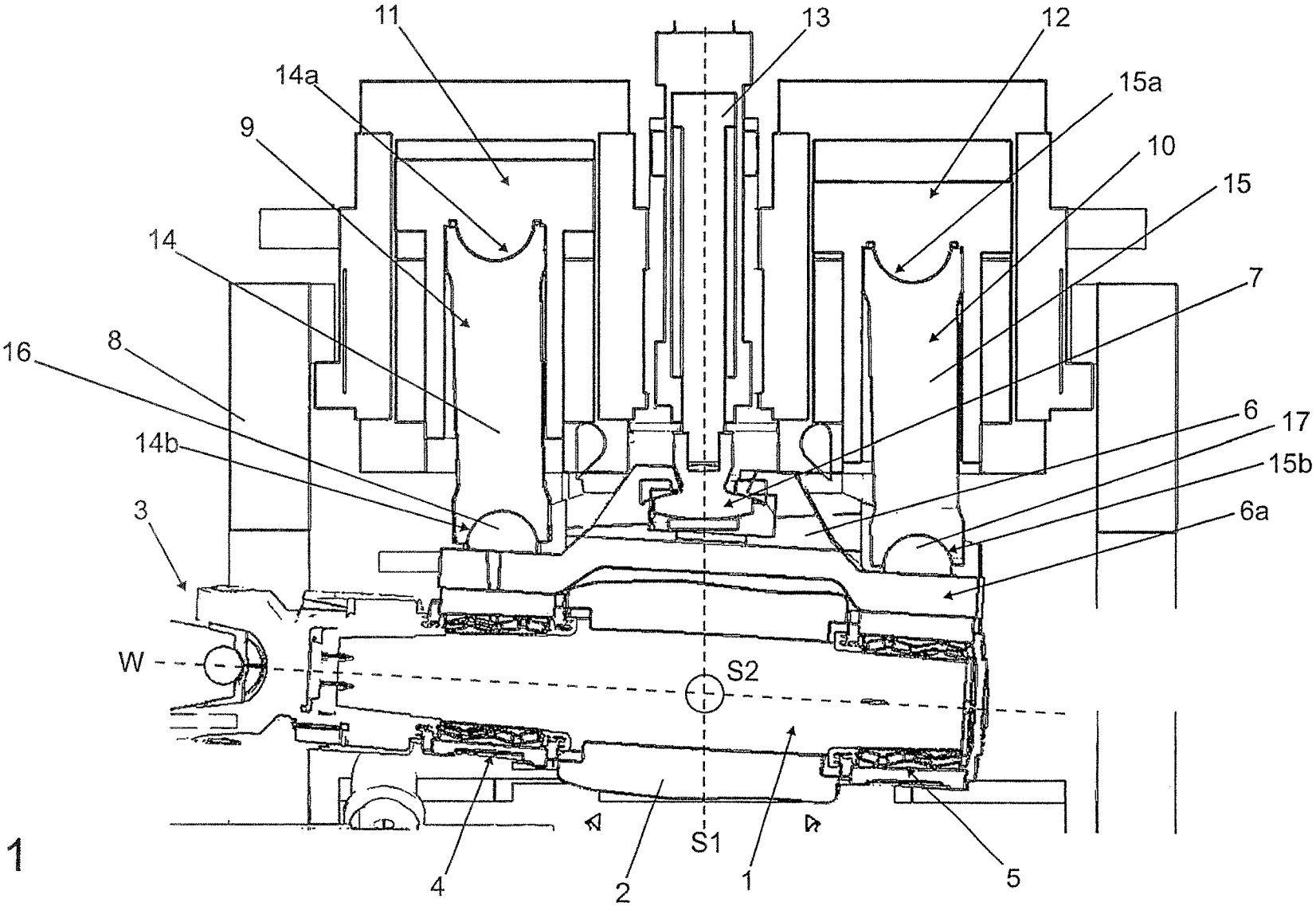
FIG. 1 shows a partially cross-sectional view of an inventive cross-rolling mill.
Figure 2:
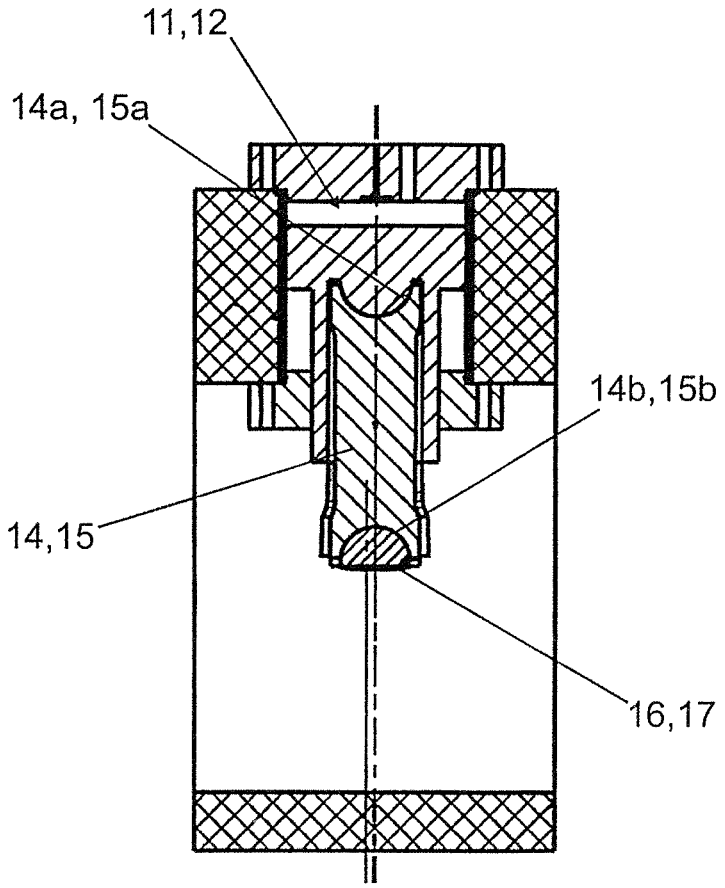
FIG. 2 shows a schematic cross-sectional view of a pivotable control element along the cross-sectional line A-A in FIG. 3.

The inventive cross-rolling mill which is shown in FIG. 1, has three structurally identically supported roll shaft 1 of which only one is shown in the drawing. The roll shaft 1 has a roll body 2 extending radially with respect to the roll axis W or in a direction of action of a rolling force on a workpiece. The roll shaft 1 is rotated by a gimbal-mounted drive shaft 3 about the roll axis W.

In front of and behind the roll body 2, there are provided, respectively, rotary bearings 4, 5 which act against the rolling forces. The rotary bearings 4, 5 are received in a roll housing 6, with the roll housing 6 being displaceably supported relative to the frame 8 of the cross-rolling will by a bearing support 7. The roll housing is adjustably pivotable about first and second adjustment a first adjustment axis S1 and a second adjustment axis S2. The second adjustment axis S2 extends, as shown in FIG. 1, perpendicular to the drawing plane. The adjustment axes S1 and S2 extend perpendicular to each other, though they do not necessarily have to intersect each other.

The roll housing 6 is formed as a rigid essentially yoke-shaped member. The roll housing 6 is supported at its two support regions 6*a*, on one hand, by the rotary bearings 4, 5 and, on another hand, by respective intermediate members 9, 10. The intermediate members are arranged between the roll housing 6 or the rotary bearings 4, 5, on one hand, and, on the other hand, two respective control elements 11, 12, on another hand.

The roll shaft 1 is adjusted by alignment of the roll housing 6 and, thus, of the rotary bearings 4, 5, at that, the control elements 11, 12, which are formed as hydraulic cylinders, should be respectively positioned. The control elements 11, 12 can transmit rolling forces acting on a workpiece.

The roll housing 6 is pulled against the rolling force by a tension member 13 formed as a hydraulic cylinder, so that the roll housing 6 is always firmly pressed against the control elements. The force applied by the tension member is smaller than the force of the control elements, which insures a play-free positioning of the roll shaft 1 and provides for release of the workpiece.

The intermediate members 9, 10 are identical and serve for compensation of adjustment-generated tilting and offset movements between the control elements 11, 12, on one hand, and the roll housing 6 or the roll shaft 1, on the other hand. The intermediate members 9, 10 include, respectively, rocker pins 14, 15. The rocker pins 14, 15 are pivotable in several directions which is achieved by spherical support of the rocker pins 14, 15.

The rocker pins are provided, on their sides, facing the control elements, with a respective concave surface 14*a*, 15*a*, whereas the control elements are provided with corresponding convex spherical surfaces. On their sides facing the roll shaft, the rocker pins are likewise provided with concave spherical surfaces 14*b*, 15*b*.

At the ends of the rocker pins 14, 15, there are provided substantially semi-spherical bearing caps 16, 17. Those are pivotable by the spherical surfaces 14*b*, 15*b* relative to the rocker pins, with their plane opposite surfaces lying on the roll housing. Thereby, if necessary, a lateral offset of the opposite surfaces relative to the roll housing becomes possible.

It should be understood that in other embodiments reversely curved spherical surfaces can be provided, e.g., convex spherical surfaces on the rocker pins 14, 15 and correspondingly concave spherical surfaces on the control elements 11, 12 and/or the bearing caps 16, 17.

The adjustment of the roll housing about the adjustment axis S1 extending perpendicular to the drawing plane of FIG. 1 is effected by adjustment devices, not shown, which act perpendicular to the drawing direction and, thus, not in the direction of action of the rolling force. Generally, the rocker pins 14, 15 are pivotable, starting from a neutral position, in each spatial direction by a smallest angle about a rotation point. The rotational points lie in the geometrical center of the rocker pin side of the spherical surface.

Figure 3:
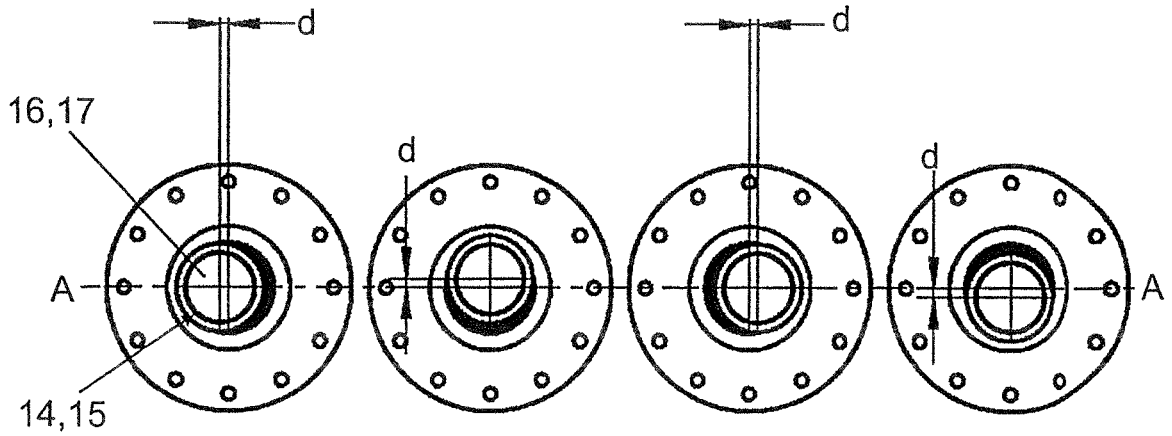
FIG. 3 shows a plan view of the control element shown in FIG. 2 in four outmost pivotal positions.

FIG. 3 in which one of the rocker pins 14, 15 is shown, illustrates pivotal movements of the rocker pin by an angle in four different exemplary spatial directions up to a stop. The pivotal movement provide for a maximal lateral offset d of the opposite surfaces of the bearing caps 16, 17.

LIST OF REFERENCE NUMERALS

1 Roll shaft
2 Roll body
3 Drive shaft, universal joint
4 First rotary bearing
5 Second rotary bearing
6 Roll housing
6*a* Support areas of the roll housing
7 Roll housing support
8 Frame
9 First intermediate member
10 Second intermediate member
11 First control element
12 Second control element
13 Tension member
14 First rocker pin
14*a* Concave spherical surface
14*b* Concave spherical surface
15 Second rocker pin
15*a* Concave spherical surface
15*b* Concave spherical surface
16 First bearing cap
17 Second bearing cap
W Roll axis
S1 First adjustment axis
S2 Second adjustment axis
d Lateral offset

The invention claimed is:

1. A cross-rolling mill, comprising:

a plurality of roll shafts (1), each having a rotary bearing and applying a radially directed rolling force to a workpiece, wherein an orientation of a roll axis (w) of at least one of the roll shafts (1) is adjustable about a first adjustment axis (S1) and a second adjustment axis (S2); and an intermediate member (9, 10) arranged between the rotary bearing (4, 5) of at least one of the roll shafts and a control element (11, 12), said at least one intermediate member (9, 10) comprising a rolling force-transmitting rocker pin (14, 15) having a spherical surface (14 *a*, 14 *b*, 15 *a*, 15 *b*), said rocker pin supported via the spherical surface for pivotal movement of the rocker pin in a plurality of directions relative to the one of the roll shafts.

2. The cross-rolling mill according to claim 1, further comprising at least one said rocker pin and at least one said rotary bearing arranged at respective opposite ends of each of said roll shafts.

3. The cross-rolling mill according to claim 1, characterized in that each of the roll shafts (1) is received in a roll housing (6), said roll housing (6) movably supported about adjustment axes (S1, S2), said rocker pin (14, 15) supported against the roll housing (6) of the one of the roll shafts.

4. The cross-rolling mill according to claim 3, further comprising a tension member (13), which applies a force to the roll housing (6) in a direction opposite a direction of the rolling force.

5. The cross-rolling mill according to claim 1, characterized in that the rocker pin (14, 15) engages at least at one end thereof, a bearing cap pivotable relative to the rocker pin.

6. The cross-rolling mill according to claim 1, characterized in that the rocker pin (14, 15), starting from a neutral position, is pivotable about a rotational point by an angle in each spatial direction.

7. The cross-rolling mill according to claim 1, characterized in that at least two of the roll shafts (1) are adjustable about the first adjustment axis (S1) and a second adjustment axis.

8. The cross-rolling mill according to claim 7, wherein at least three of the roll shafts are adjustable about the first adjustment axis (S1) and a second adjustment axis.

9. The cross-rolling mill according to claim 7, wherein all of the roll shafts are adjustable about the first adjustment axis (S1) and a second adjustment axis.

10. The cross-rolling mill according to claim 4, wherein the tension member is a hydraulic tension member.

* * * * *